United States Patent [19]

Phillips

[11] 3,961,544

[45] June 8, 1976

[54] ACTUATOR MECHANISM

[75] Inventor: Ronald Phillips, Northolt, England

[73] Assignee: C.A.V. Limited, Birmingham, England

[22] Filed: Apr. 12, 1974

[21] Appl. No.: 460,530

Related U.S. Application Data

[63] Continuation of Ser. No. 457,701, April 4, 1974, abandoned.

[30] Foreign Application Priority Data

Apr. 14, 1973 United Kingdom ..... 18095/73

[52] U.S. Cl. ..... 74/513; 74/501 R; 74/99 R

[51] Int. Cl.[2] ..... G05G 1/14

[58] Field of Search ..... 74/501, 482, 99; 123/110, 198 D, 198 DB

[56] References Cited

UNITED STATES PATENTS

| | | | |
|---|---|---|---|
| 1,632,940 | 6/1927 | Wright | 74/513 |
| 2,236,145 | 3/1941 | Kolb | 74/513 |
| 3,115,951 | 12/1963 | Fox | 123/198 DB |
| 3,293,937 | 12/1966 | Gardner | 74/513 |
| 3,418,867 | 12/1968 | Maeda | 74/501 |
| 3,695,379 | 10/1972 | Veilleux | 123/198 D |

*Primary Examiner*—Samuel Scott
*Assistant Examiner*—Wesley S. Ratliff, Jr.
*Attorney, Agent, or Firm*—Kane, Dalsimer, Kane, Sullivan and Kurucz

[57] ABSTRACT

The invention relates to an actuator mechanism for the fuel quantity control member of a fuel injection pump. The mechanism includes an output member which is driven by an electro-magnetic device and the flexible member which is connected to the control member of the injection pump. An arm is angularly movable about the output member and is connected to the link and a helically coiled torsion spring is provided to transmit motion between the output member and the radial arm. The control member mounts an abutment which can be contacted by a lever to move the control member towards the position of minimum fuel irrespective of the setting of the output member. During such movement, the spring is stressed.

6 Claims, 4 Drawing Figures

ACTUATOR MECHANISM

This is a continuation of application Ser. No. 457,701 filed Apr. 4, 1974, now abandoned.

This invention relates to actuator mechanism for the fuel quantity control member of a fuel injection pump, the mechanism being of the kind comprising an electromagnetic device for moving the control member to increase the quantity of fuel supplied by the pump against the action of resilient means.

The object of the invention is to provide such a mechanism in a simple and convenient form.

According to the invention, in a actuator mchanism of the kind specified, said resilient means is acted upon directly by said device, there being interposed intermediate the control member and said device, a yieldable connection whereby the control member may be moved towards a predetermined position irrespective of the setting of the device, by the application of external force.

One example of an actuator mechanism in accordance with the invention will now be described with reference to the accompanying drawings in which.

Figure 2:
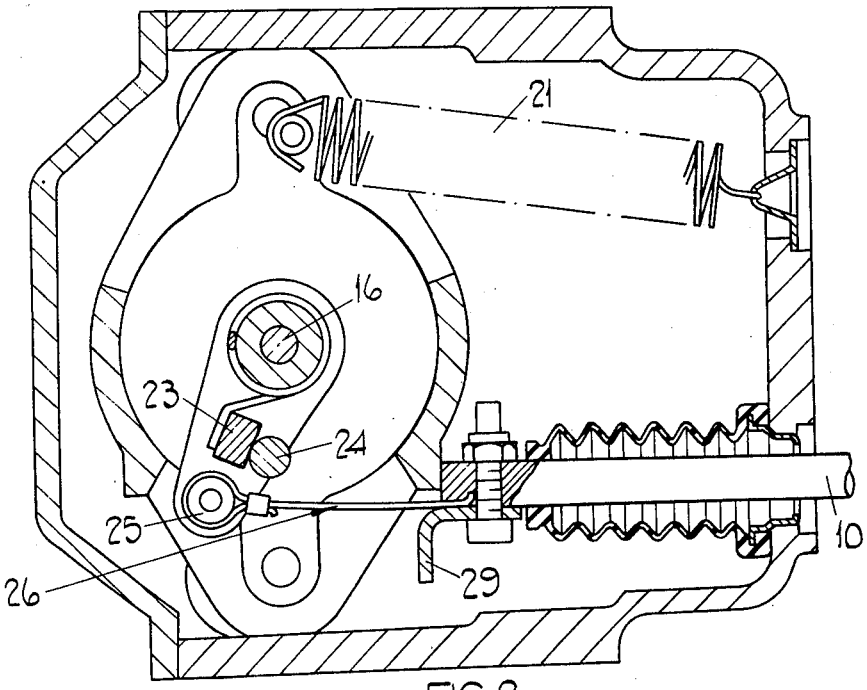
FIG. 2 shows a sectional inverted plan view on the line A—A of FIG. 1.

Referring to the drawings, the actuating mechanism is shown as applied to the fuel control rod 10 of the fuel injection pump. The fuel injection pump includes a casing, a portion of which is seen at 11 and in which is supported a rotary shaft 12. The shaft 12 carries cams for actuation of individual injection pumps in a manner well known in the art. The fuel control rod 10 is axially movable to adjust the amount of fuel supplied at each injection stroke by the injection pumps, and as shown in FIG. 2 of the drawings, movement of the control rod 10 towards the right effects an increase in the amount of fuel supplied at each injection stroke. The actuator mechanism is contained within a housing 13 which conveniently is secured to the housing 11 of the injection pump.

Located within the housing 13 is an electro-magnetic device generally indicated at 14 and which includes an angularly movable rotor 15 carried upon an output shaft 16. The device also includes a field structure which comprises a winding 17 surrounding a core 18 of laminated construction. When electrical power is supplied to the coil 17, a magnetic field is created which results in angular movement of the rotor 15. As viewed in FIG. 2, anti-clockwise movement of the rotor occurs when electrical power is supplied to the coil 17, and this as will be described, effects as increase in the quantity of fuel supplied at each injection stroke of the injection pump.

Figure 1:
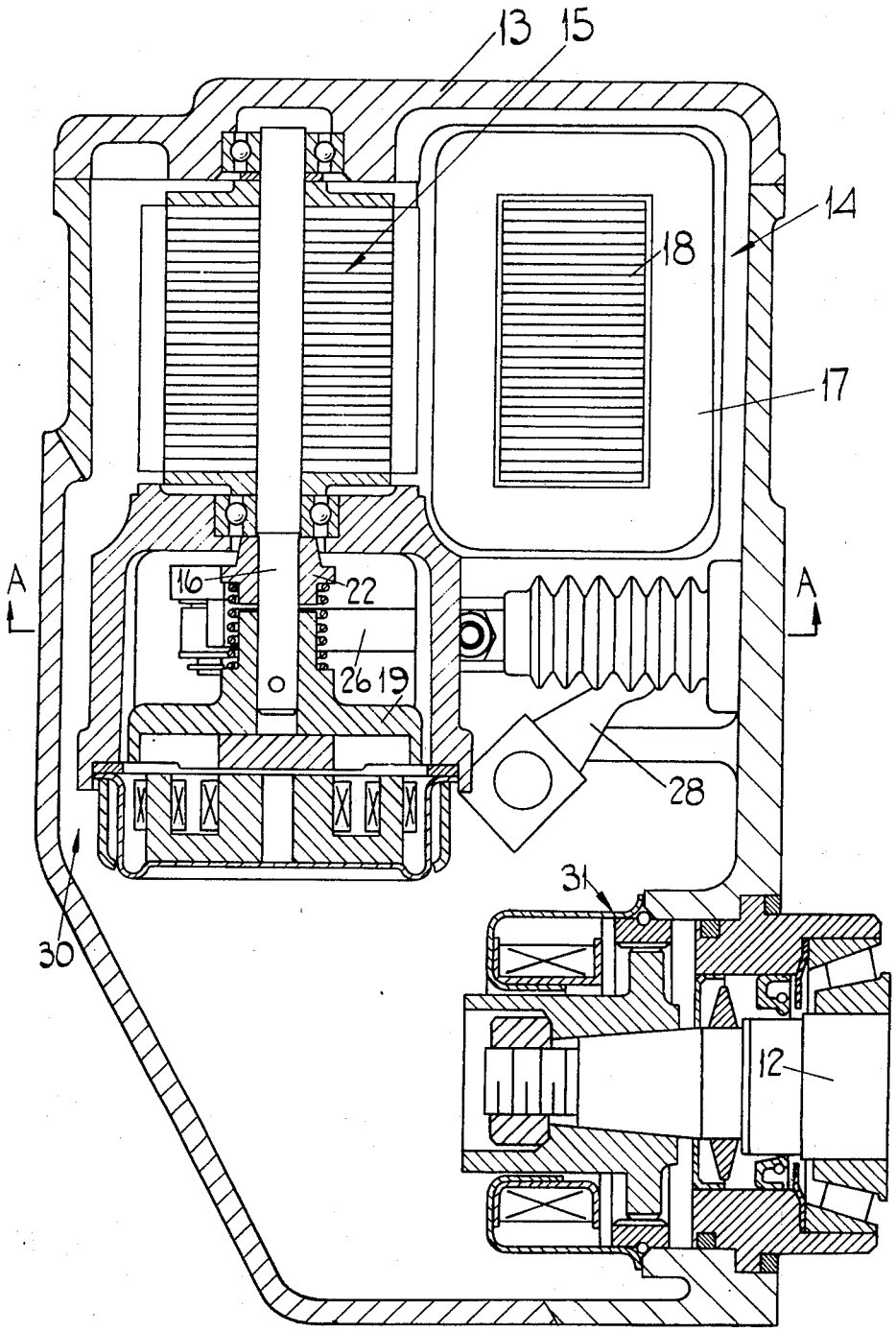
FIG. 1 shows a sectional side elevation of the mechanism.
Figure 3:
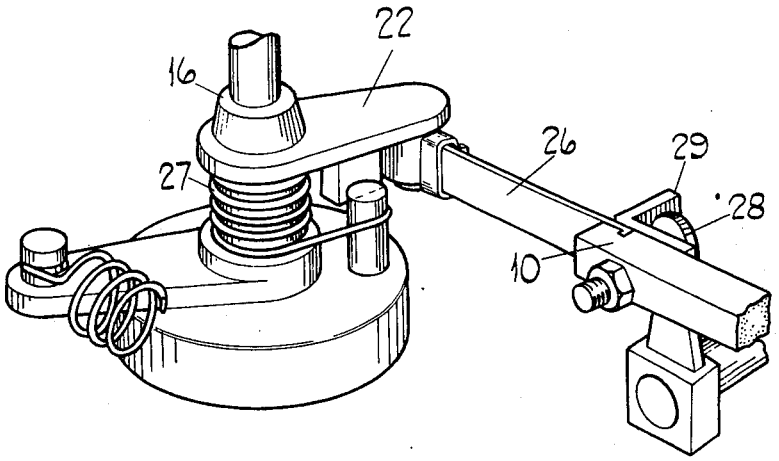
FIG. 3 shows a prospective view of the essential components shown in FIGS. 1 and 2.
Figure 4:
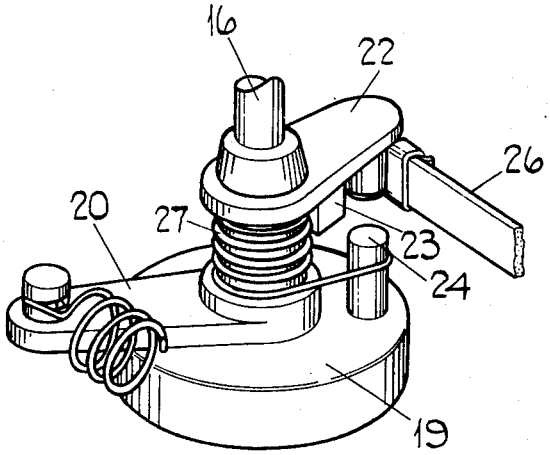
FIG. 4 shows part of the view seen in FIG. 3 with various parts in alternative positions.

As best seen in FIGS. 1, 3 and 4, the output shaft 16 is coupled to a disc 19 having a radially extending arm 20, and this is connected to one end of a coiled tension spring 21, the other end of which is secured to a part of the housing. Moreover, located about the shaft 16 is a radially extending arm 22 on the underside of which is a projection 23. A further projection 24 is provided on the disc 19, whilst a peg 25 at the end of the arm 22 is pivotally connected to one end of a link 26, the other end of which is rigidly connected to the end of the control rod 10.

The projections 23 and 24 are urged into engagement with each other by means of a spring 27 loosely engaged about a boss on the disc 19. The ends of the spring are engaged around the projections 23 and 24 respectively, and as stated, the projections 23 and 24 are held in engagement with each other by the force exerted by the spring.

In operation, the spring 21 acts through the intermediary of the projections 23, 24 to urge the control rod 10 towards a position of minimum fuel supply. When electric power is supplied to the coil 17, angular movement is imparted to the shaft 16 and the disc 19 which is directly coupled to the shaft, also moves angularly. This movement is directly resisted by means of the spring 21. The arm 22 is also moved angularly to effect movement of the control rod 10 to increase the quantity of fuel supplied to the engine, and during this movement the force required to effect movement of the control rod 10 is transmitted through the spring 27 which is pre-stressed by a sufficient amount that the projections 23, 24 normally remain in contact with each other. Moreover, the movement of the control rod 10 is along its longitudinal axis, and the movement of the peg or pivot pin 25 is in the form of an arc about the axis of the output shaft 16. The discrepancy in this movement is accommodated by flexure of the link 26 which is made suitably resilient for this purpose but is sufficiently stiff to ensure that the correct movement is imparted to the control rod 10.

Variation in the electric current flowing in the coil 17 will effect variation in the setting of the control rod 10, and the flow of electric current to the coil 17 is controlled by an electronic circuit which is responsive to driver demand and engine speed amongst other things. In the event that the spring 21 breaks, there will be substantially no restraining force on the angular movement of the rotor 15. Moreover, the possibility exists that the shaft 16 may stick in some intermediate position and despite the fact that the supply of power to the coil 17 may be cut off, the spring 21 may be unable to effect the requisite angular movement of the shaft 16.

There is therefore provided a stop lever 28 which is engageable with an abutment 29 carried by the control rod. The stop 28 is connected to linkage exterior of the apparatus so that in the event of an emergency, force can be applied to the control rod 10 to move it to the minimum or zero fuel position. When the stop lever 28 is actuated, the link 26 effects angular movement of the arm 22, and if the output shaft 16 is jammed, the force exerted by the spring 27 will be overcome and the projections 23 and 24 will move apart. Such a condition is shown in FIG. 4. With the control in the minimum or zero fuel condition, then clearly the engine will either idle or stop. In the event that the output shaft 16 has not jammed, but the spring 21 has broken, then angular movement of the arm 22 will probably result in angular movement of the disc 19 and no separation of the projections 23 and 24 will occur. However, the control rod will still be moved to the minimum or zero fuel position.

As shown in FIG. 1, the disc 19 forms part of a transducer 30 capable of providing an electrical signal indicative of the angular position of the shaft 16, and therefore the axial position of the control rod. The output of the transducer is fed to the electronic control circuit previously described. In addition, the shaft 12 carries the rotor of a small generator 31 which provides an alternating current signal, the frequency of which varies in accordance with the speed at which the shaft 12 is driven. The shaft 12 is driven in timed relationship with the associated engine, and therefore the signal obtained from the generator can be utilised to provide a signal indicative of the speed of the engine. This signal is also fed to the electronic control circuit, previously mentioned.

I claim:

1. An actuator mechanism for the fuel quantity control member of a fuel injection pump and comprising an electromagnetic device including an angularly movable drive shaft, an ouput member in the form of an arm mounted for angular movement relative to said shaft, means coupling said arm to said control member, further means coupling said arm to said shaft for moving the control member to increase the amount of fuel supplied by the pump, resilient means acting on the shaft for opposing movement of the shaft in the direction to increase the amount of fuel, a yieldable connection included in said further means whereby the control member may be moved towards a predetermined position irrespective of the setting of the shaft by the application of external force.

2. An actuator mechanism as claimed in claim 1 including a movable stop lever and an abutment on the control member for engagement by said stop lever.

3. An actuator mechanism as claimed in claim 2 in which said further means comprises a disc secured to said shaft, a peg mounted on said disc, a further peg carried by said arm for co-operation with the peg carried by said disc, said yieldable connection comprising a helical spring, the ends of said helical spring being engaged with said pegs respectively, the spring acting to urge said pegs into engagement with each other.

4. An actuator mechanism as claimed in claim 3 in which said means comprises a flexible link interposed between the arm and said control member.

5. An actuator mechanism as claimed in claim 4 in which said disc forms part of a transducer for providing an indication of the position of the control member.

6. An actuator mechanism as claimed in claim 4 in which said resilient means comprises a coiled tension spring connected between a housing of the mechanism and an arm connected to said output member.

* * * * *